US007503267B1

(12) United States Patent
Zemel et al.

(10) Patent No.: US 7,503,267 B1
(45) Date of Patent: Mar. 17, 2009

(54) FOLDABLE SUPPORT SYSTEM

(75) Inventors: Marc Zemel, Melville, NY (US); Wayne B. Margolin, Kowloon (CN)

(73) Assignee: Mr. Bar-B-Q-, Inc., Old Bethpage, NY (US)

( * ) Notice: Subject to any disclaimer, the term of this patent is extended or adjusted under 35 U.S.C. 154(b) by 91 days.

(21) Appl. No.: 11/779,219

(22) Filed: Jul. 17, 2007

(51) Int. Cl.

| | |
|---|---|
| ***A47B 3/00*** | (2006.01) |
| *F16M 11/20* | (2006.01) |
| *A47G 23/02* | (2006.01) |
| *A47F 5/02* | (2006.01) |
| *F16C 11/00* | (2006.01) |

(52) U.S. Cl. ..... 108/115; 108/124; 108/126; 248/188.1; 248/130; 248/150; 403/61

(58) Field of Classification Search ..... 108/115, 108/117, 120, 121, 123, 127, 128, 68, 99, 108/160, 158, 126, 129, 19, 36, 35, 124; 126/9 B; 248/130, 136, 133, 150, 152, 188.6, 248/167, 166, 188.1; 16/325, 326, 348, 350, 16/355, 318, 344; 403/112, 113, 116, 61
See application file for complete search history.

(56) References Cited

U.S. PATENT DOCUMENTS

| | | | | |
|---|---|---|---|---|
| 429,977 | A | 6/1890 | Thomas | |
| 2,020,503 | A | 11/1935 | Hanson | |
| 2,581,658 | A * | 1/1952 | Hicks | 108/19 |
| 2,873,987 | A * | 2/1959 | Larson | 403/61 |
| 3,529,697 | A * | 9/1970 | White et al. | 182/186.2 |
| 3,566,856 | A | 3/1971 | Linstead | |
| 3,610,224 | A | 10/1971 | Marshall | |
| 4,385,619 | A | 5/1983 | Casinelli | |
| 4,735,392 | A | 4/1988 | Farmer | |
| 5,293,859 | A | 3/1994 | Lisker | |
| 6,428,242 | B1 * | 8/2002 | Ward | 405/220 |
| 7,086,395 | B1 | 8/2006 | Li | |
| 2006/0191448 | A1 | 8/2006 | Chen | |

* cited by examiner

*Primary Examiner*—Derris H Banks
*Assistant Examiner*—Andres Gallego
(74) *Attorney, Agent, or Firm*—Seth Natter; Natter & Natter

(57) ABSTRACT

A foldable support system includes a sheet metal flange depending from a table and a sheet metal leg. A pivot pin extends through a slot in the flange and an aperture in the leg so that the leg may rotate and slide relative to the flange. The flange includes a bent tab which extends toward and beyond the leg and the leg includes an arcuate cut out channel having a mouth at a side edge of the leg and a cut out receptacle at its inner end. The bent tab is received in the receptacle to lock the leg in an unfolded position when the pivot pin is at the top of the slot, while the bent tab is within the channel to permit the leg to be rotated to a folded position, when the pivot pin is at the bottom of the channel.

20 Claims, 3 Drawing Sheets

FOLDABLE SUPPORT SYSTEM

BACKGROUND OF THE INVENTION

1. Field of the Invention

The present invention relates generally to foldable support mechanisms and more particularly to a system for pivotally joining legs to a table or panel above a support surface.

2. Antecedents of the Invention

Jalapeño peppers require a drying and cooking process, in which they are cooked in an upright position over a heat source, such as heated coals, a gas barbecue burner, etc. or left in the sun to dry and cure. Racks have been provided that include apertures into which the elongate peppers are inserted and maintained in substantially upright positions during the drying or cooking process, with the racks being elevated sufficiently above a heat grid, countertop, table or other surface, such that the peppers are maintained in a generally upright position. While legs have been utilized to elevate racks above the heat grid, countertop, table, etc., it has been found desirable to collapse or fold racks to a compact state when not in use, e.g. for home storage, to enable the rack to fit in a dishwasher, for reducing transportation and warehousing costs and to conserve retail shelf space.

Thus, there is a need for providing a jalapeño pepper curing rack having legs which are easily foldable.

SUMMARY OF THE INVENTION

In compendium, a jalapeño pepper rack includes vertical supports for positioning a generally planar panel above a surface. Each support includes a pair of legs pivotally joined to planar flanges extending from the underside of the panel, with a pivot pin seated in a vertical slot of the flange, so that the support is rotatable relative to the panel and the flange about the pin and is capable of vertical translational movement, within a path defined by the height of the flange slot.

The flange includes a first bent tab beneath and in registration with the flange slot and a second bent tab, which extends from a side surface of the flange at an elevation above that of the first tab. Both tabs extend perpendicularly from the plane of the flange toward the support.

An arcuate channel cut into each leg extends from a mouth in a side of the leg to a depending cutout tail, which extends downwardly along a longitudinal axis of the leg. Each support is locked in a support position, with the first tab seated within the tail, to preclude rotation of the support about the pin. Additionally, because the second tab is not registered with the mouth of the arcuate channel and instead abuts a side edge of the leg, an auxiliary restraint against rotation of the leg is provided.

To release the locking engagement and fold, i.e. rotate, the support, the support is pulled downwardly and away from the panel, until the pivot pin is seated at the bottom of the flange slot, whereby the first tab is no longer seated in the tail, but is positioned within the arcuate channel and the second tab is now registered with the arcuate channel. The support legs may then rotate about the pivot toward a folded position. At approximately a midpoint of rotation, a cam formed in the channel contour, engages the first bent tab. Continued rotation results in the cam riding over the tab and causes the leg to move upwardly and the pivot pin to move from the bottom of the slot toward the middle, such that the support cannot be rotated back into the unfolded position without lowering the pivot pin, hence the support, because the channel mouth is no longer registered with the first bent tab.

From the foregoing compendium, it will be appreciated that it is an aspect of the present invention to provide a foldable support system for a table or panel which is not subject to the disadvantages of the antecedents of the invention aforementioned.

A feature of the present invention is to provide a foldable support system for a table or panel of the general character described which is relatively low in cost.

A consideration of the present invention is to provide a foldable support system for a table or panel of the general character described which may be fabricated by economical metal stamping techniques.

Another consideration of the present invention is to provide a foldable support system for a table or panel of the general character described which may be easily cleaned after usage.

Another feature of the present invention is to provide a foldable support system for a table or panel of the general character described with relatively few parts.

A further aspect of the present invention is to provide a foldable support system for a table or panel of the general character described having relatively low tooling costs.

An additional consideration of the present invention is to provide a foldable support system for a table or panel of the general character described which easily folds to a compact size.

A still further aspect of the present invention is to provide a foldable support system for a table or panel of the general character described having reduced product shipping costs.

To provide a foldable support system for a table or panel of the general character described with reduced product warehousing costs is a further consideration of the present invention.

Another feature of the present invention is to provide a foldable support system for a table or panel of the general character described which may be readily cleaned in a residential dishwasher.

To provide a foldable support system for a table or panel of the general character described which is sturdy and can withstand the rigors of extended usage is a still further aspect of the present invention.

Another feature of the present invention is to provide a foldable support system for a table or panel of the general character described which is relatively simple to use.

Yet a further consideration of the present invention is to provide a foldable support system for a table or panel of the general character described which is durable.

To provide a foldable support system for a table or panel of the general character described which can withstand repeated exposure to elevated cooking temperatures without degradation is a further aspect of the present invention.

With these ends in view, the invention finds embodiment in the various combinations of elements, arrangements of parts and series of steps by which the aforesaid aspects, features and considerations and certain other aspects, features and considerations are attained, all with reference to the accompanying drawings and the scope of which will be more particularly pointed out and indicated in the appended claims.

BRIEF DESCRIPTION OF THE DRAWINGS

In the accompany drawings in which are shown one of the various possible exemplary embodiments of the invention.

DESCRIPTION OF THE PREFERRED EMBODIMENT

Figure 1:
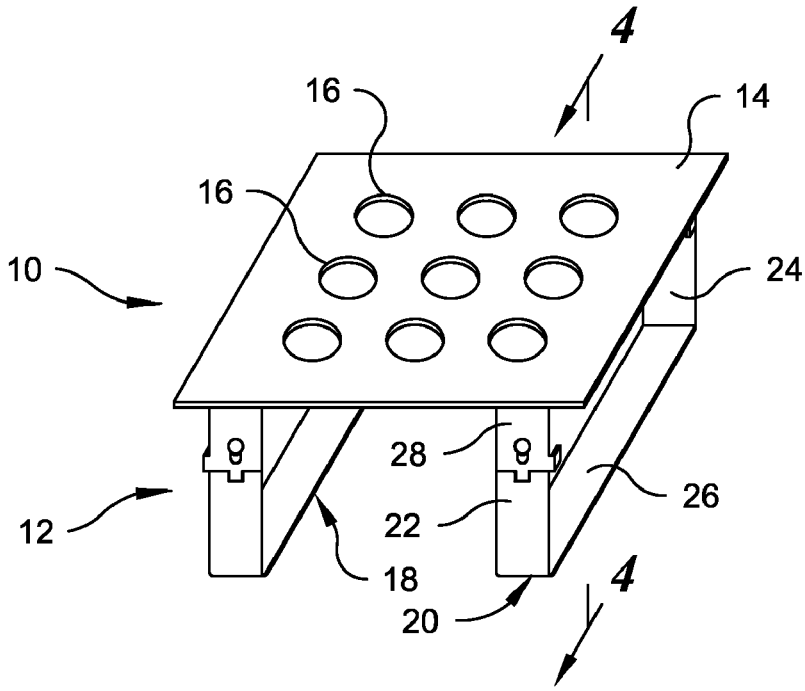
FIG. 1 is a perspective view of a jalapeno pepper rack having an upper panel or table and a foldable support system constructed in accordance with and embodying the invention and illustrating a pair of supports at opposed ends of the rack, with each support including a pair of upright legs joined by a stringer and illustrating the legs rotatably coupled to flanges which depend from beneath the table.

Referring now in detail to the drawings, the reference numeral 10 denotes generally a jalapeno pepper rack which includes a foldable support system 12 constructed in accordance with and embodying the invention.

The rack 10 comprises a generally planar table or panel 14 having a plurality of apertures 16 dimensioned to accommodate jalapeno peppers. It is to be understood, however, that the foldable support system of the present invention should not be construed as being limited to jalapeno pepper racks and may be employed to support any table, panel, work surface, etc., above a base surface, such as a floor, deck, table, counter or bench top or the ground itself.

Pursuant to the invention, the rack 10 is maintained in a generally horizontal position spaced above a base surface, such as a heat grid or barbecue grill, by a pair of supports 18, 20. The supports 18, 20 are of substantially identical configuration, the sole difference being that, as viewed in FIG. 1, they are oriented in opposite directions. Accordingly, the support 20 will hereinafter be described, it being understood that the support 18 is substantially identical thereto. The supports 18, 20 are preferably fabricated sturdy of steel sheet metal, preferably in the order of 16 gauge, by way of a stamping or die cutting process.

The support 20 includes a pair of generally planar legs 22, 24 which extend in parallel vertical planes, with the bottoms of each leg 22, 24 being joined by a stringer 26, to provide a relatively broad surface for engaging a heat cooking grid or barbecue grill formed of spaced parallel rods. It should be appreciated that the entire support 20 is economically formed from a single piece of steel sheet metal having a thickness within the range of 15 to 17 gauge.

It should also be appreciated that the leg 24 comprises a mirror image of the leg 22. A pair of steel sheet metal, e.g. 16 gauge, brackets 28 extend downwardly from the underside of the table 14 at opposite ends thereof. The legs and brackets are of substantially equal width, e.g. ⅞ inch. Each bracket 28 comprises a generally planar flange 30 having a central vertical slot 32 and a first bent tab 34 at its lowermost edge. The first bent tab 34 projects toward the opposite registered bracket. The flange 30 additionally includes a second bent tab 36, which projects in the same direction as the first bent tab 34, extending from a side edge of the flange 30 at an elevation above that of the first tab 34. The legs 22, 24 of the support 20 are nested between the opposed flanges 30.

Figure 2:
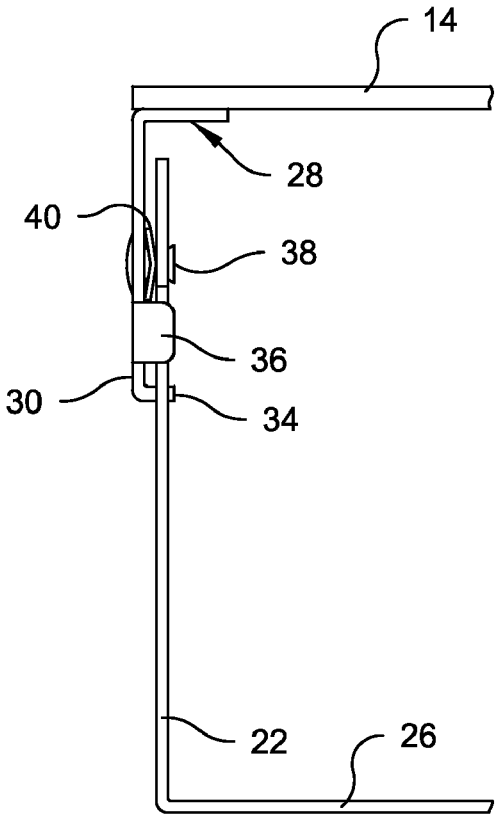
FIG. 2 is an enlarged scale fragmentary side elevational view of the rack and a portion of one of the supports.
Figure 3:
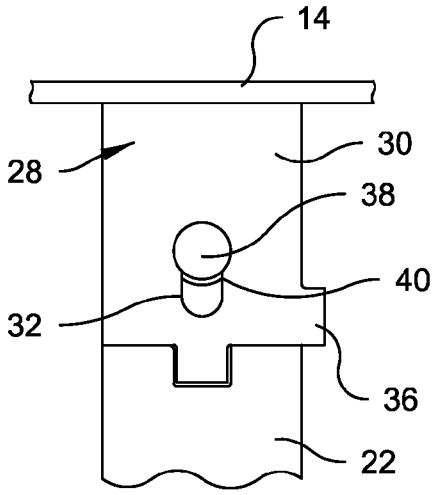
FIG. 3 is a fragmentary front elevational view of the rack and support depicted in FIG. 2 and showing a pivot pin seated in a vertical slot of the flange.

A pivot pin or rivet 38 is seated in the slot 32 and extends through an aperture formed in the leg 22. A washer 40 may be positioned between the inner face of the flange 30 and the leg 22 as illustrated in FIG. 2 and FIG. 3. Lateral stability for the table is assured with the legs 22, 24 nested between the brackets 28.

Figure 4:
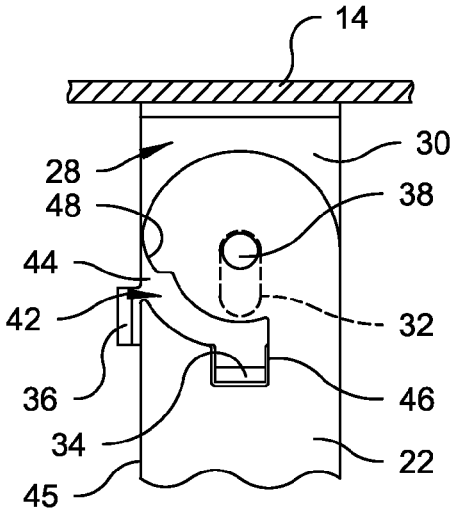
FIG. 4 is an enlarged scale fragmentary sectional view through the rack and illustrating a rear elevation of the support depicted in FIG. 3 including a leg rotatably coupled to the bracket about the pivot pin and an arcuate channel formed in the leg, with the leg locked in an operative position for supporting the table.

An arcuate channel 42 is die cut or stamped into the leg 22 from an open mouth 44, formed in a longitudinal side edge 45 of the leg, toward a depending cut out tail 46, which extends downwardly along a longitudinal axis of the leg. With the foldable support system in an operative position, supporting the table 14, the first tab 34 is seated at the bottom of a receptacle comprising the cut out tail 46 and the second tab 36 is registered with the side edge 45 of the leg 22, adjacent and beneath the mouth 44. The support 20 is thus locked against rotation relative to the bracket 28, by both tabs, 34, 36 as illustrated in FIG. 4.

Figure 5:
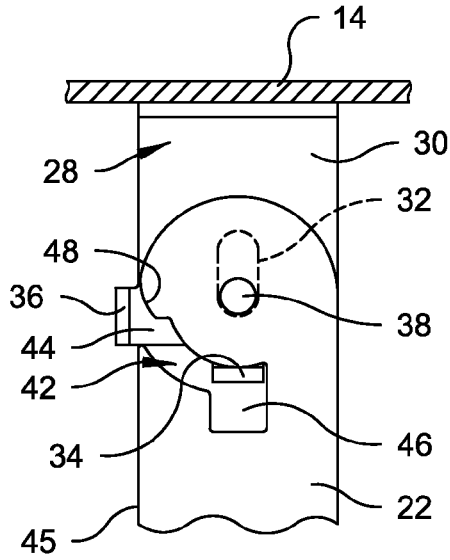
FIG. 5 is an enlarged scale fragmentary sectional view through the rack, similar to FIG. 4, however illustrating the leg in an unlocked position, with bent tabs projecting from the bracket registered with the arcuate channel.

To fold the support 20, the leg must be unlocked by being moved axially downwardly, away from the table or panel 14, to a position indicated in FIG. 5, wherein the first tab 34 is no longer within the cut out tail 46, but is within the arcuate channel 42 and the second tab 36 is now registered with the channel mouth 44. It should be noted that in such orientation, the pivot 38 is seated at the bottom of the slot 32.

The support 20, comprising both legs 22, 24 and the stringer 26, can then be rotated counterclockwise, as viewed from its FIG. 5 orientation.

Figure 6:
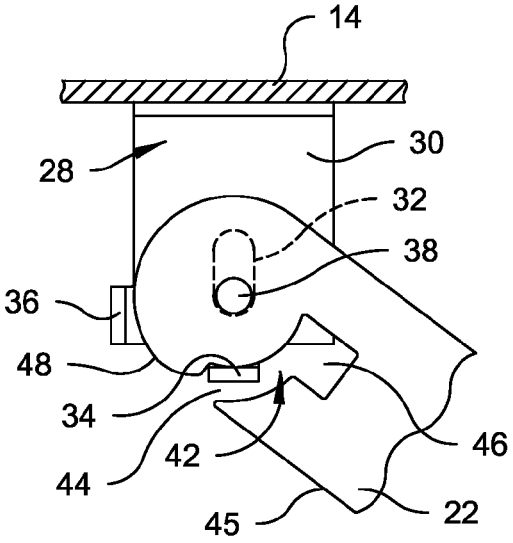
FIG. 6 is an enlarged scale fragmentary rear sectional view through the rack, similar to FIG. 5, however illustrating the leg in a partially folded position, with one of the tabs engaging a cam surface of the channel, such that further rotation of the leg causes vertical upward displacement of the leg.

From an observation of FIG. 6, it will be noted that when the leg 22 reaches a partially folded position, the upper surface of the first tab contacts a cam 48 formed in the upper surface of the cut out contour of the channel 42. Continued rotation of the leg 22 causes engagement between the cam 48 and the tab 34 to lift the leg 22 upwardly, such that the pivot pin 38 is moved from the bottom of the slot 32 toward the middle, as best seen in FIG. 7.

Figure 7:
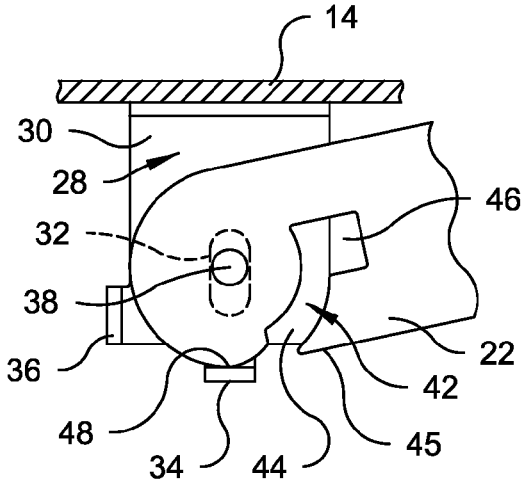
FIG. 7 is an enlarged scale fragmentary sectional view through the rack, similar to FIG. 6, but illustrating the leg in a completely folded position.
Figure 8:
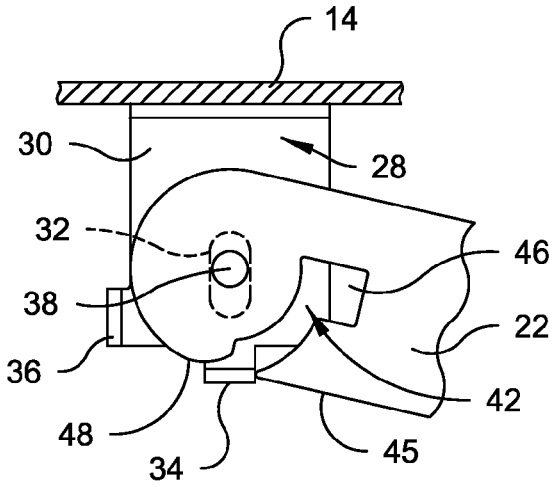
FIG. 8 is an enlarged scale fragmentary sectional view through the rack, similar to FIG. 7, illustrating a component orientation wherein return of the leg to the unfolded position is blocked.

With reference now to FIG. 7, it should be noted that the distance between the center of the pivot pin 38 and the first tab 34 is greater than the distance between the center of the pivot pin 38 and the side of the leg adjacent the mouth 44. Thus clockwise rotation of the leg will be blocked by contact between the edge of the leg and the first bent tab 34 as illustrated in FIG. 8.

In order to return the support to the unfolded and locked FIG. 4 position, the support is partially rotated counterclockwise from the FIG. 7 position and pulled downwardly, until the pivot pin 38 seats at the bottom of the slot 32, prior to attaining the FIG. 6 angle orientation. The leg can then continue rotation in a clockwise direction until reaching the FIG. 5 orientation. The leg is then urged upwardly or, the table or panel 14 urged downwardly, until the pivot pin 38 seats at the top of the slot 32 and, the first tab 34 seats at the bottom of the cut out tail 46 and the second tab 36 is registered with the side edge 45 of the leg.

Thus it will be seen that there is provided a foldable support system which achieves the various aspects, features and considerations of the present invention and which is well adapted to meet the conditions of practical usage.

As various possible further embodiments might be made of the present invention and as various changes might be made in the illustrative embodiment set forth herein without departing from the spirit of the invention, it is to be understood that all matter herein described or shown in the accompanying drawings is to be interpreted as illustrative and not in a limiting sense.

Having thus described the invention, there is claimed as new and desired to be secured by Letters Patent:

1. A foldable support system, the support system comprising a sheet metal flange configured to depend from a table and a sheet metal leg coupled to the flange for rotational and translational movement relative thereto, the leg and the flange being parallel to one another, a pivot pin extending through the flange and the leg, the flange including a first bent tab and the leg including a receptacle for receiving the bent tab upon translational movement of the leg and the flange relative to one another, whereby the leg may be rotated about the pivot pin from a folded position to an unfolded position, with the bent tab being thereafter seated in the receptacle to fix the leg in the unfolded position by translational movement of the leg relative to the flange.

2. A foldable support system in accordance with claim 1 wherein the receptacle comprises a cut out portion of the leg.

3. A foldable support system in accordance with claim 1 further including a slot formed in the flange, the pivot pin extending through the slot, whereby translational movement of the leg relative to the flange is guided by engagement between the pivot pin and the slot.

4. A foldable support system in accordance with claim 3 wherein the slot includes a top and a bottom and the flange includes a second bent tab, the second bent tab being registered with the longitudinal side edge of the leg adjacent to the mouth when the pivot pin is at the top of the slot and being registered with the mouth when the pivot pin is at the bottom of the slot.

5. A foldable support system in accordance with claim 3 wherein the pivot pin is positioned at a top of the slot when the leg is fixed in the unfolded position and is positioned at the bottom of the slot to commence rotation of the leg from the unfolded position to the folded position.

6. A foldable support system in accordance with claim 5 wherein the arcuate cut out channel includes a cam surface, the cam surface being engaged by the first bent tab when the leg is rotated about the pivot pin from the unfolded position toward the folded position, the engagement between the cam surface and the first bent tab causing the pivot pin to elevate from the bottom of the slot upon continued rotation.

7. A foldable support system in accordance with claim 1 further including an arcuate cut out channel formed in the leg, the receptacle being positioned at an inner end of the channel, the channel having a mouth at a longitudinal side edge of the leg.

8. A foldable support system in accordance with claim 1 further including a table, the sheet metal flange depending from the table, a second sheet metal flange depending from the table and a second leg coupled to the second flange, the legs being joined at their lower ends by a steel sheet metal stringer, whereby the table may rest on a base surface comprising a barbecue grill formed of spaced parallel rods.

9. A foldable support system for a table in accordance with claim 8 further including a further pair of sheet metal flanges depending from the table and a further pair of sheet metal legs coupled to the flanges, the further pair of legs being joined to one another at their lower ends by a second sheet metal stringer.

10. A foldable support system for a table in accordance with claim 1 wherein the sheet metal flange and the sheet metal leg comprise steel sheet metal in the order of 16 gauge.

11. A table having a foldable support system, the support system comprising a steel sheet metal flange depending from the table and a steel sheet metal leg coupled to the flange for rotational and translational movement relative thereto, the leg and the flange being parallel to one another, a pivot pin extending through the flange and the leg, a slot formed in the flange, the pivot pin extending through the slot, the flange including a first bent tab and the leg including an arcuate cut out channel extending into the leg from a mouth at a longitudinal side edge of the leg, the channel receiving the bent tab upon rotational movement of the leg relative to the flange when the pivot pin is positioned at one end of the slot, whereby the leg may be rotated about the pivot pin from a folded position to an unfolded position.

12. A table having a foldable support system for a table in accordance with claim 11 further including a cut out receptacle formed in the leg at an inner end of the channel, the first bent tab being registered with the receptacle when the leg is in the unfolded position, the first bent tab being seated in the receptacle to fix the leg in the unfolded position when the pivot pin is positioned at the other end of the slot.

13. A table having a foldable support system in accordance with claim 12 wherein the flange includes a second bent tab, the second bent tab being registered with the longitudinal side edge of the leg adjacent the mouth when the first bent tab is seated in the receptacle and being registered with the mouth when the first bent tab is not seated in the receptacle.

14. A table having a foldable support system in accordance with claim 12 wherein the slot includes a top and a bottom and the pivot pin is positioned at the top of the slot when the leg is fixed in the unfolded position and is positioned at the bottom of the slot to commence rotation of the leg from the unfolded position to the folded position.

15. A table having a foldable support system in accordance with claim 11 further including a second steel sheet metal flange depending from the table and a second steel sheet metal leg coupled to the flange, the legs being joined at their lower ends by a steel sheet metal stringer, whereby the table may rest on a base surface comprising a barbecue grill formed of spaced parallel rods.

16. A foldable support system, the support system comprising a one piece sheet metal support, the support including a pair of parallel legs, the lower ends of the legs being joined by a stringer, the support system further including a pair of steel sheet metal flanges configured to depend from a table, the legs being nested between said flanges, each leg being pivotally connected to an adjacent flange by a hinge pin for lateral stability of the table, each flange including a bent tab extending toward and beyond its pivotally connected leg, each leg including an arcuate cut out channel for accommodating the bent tab, the cut out channel extending into the leg from a mouth formed at a longitudinal edge of the leg.

17. A foldable support system for a table in accordance with claim 16, each flange further including a slot, the hinge pin extending through the slot, whereby each leg is capable of both rotational and translational movement relative to its respective flange, each leg further including a cut out receptacle formed at an interior end of the arcuate cut out channel, whereby each leg may be pivoted about its hinge pin from a folded position to an unfolded position, wherein the bent tab is registered with the receptacle and the bent tab may thereafter be seated within the receptacle to fix the leg in the unfolded position by lateral movement of the legs relative to the flange.

18. A foldable support system in accordance with claim 17 wherein each flange further includes a second bent tab, the second bent tab being registered with the mouth when the first bent tab is within the arcuate cut out channel and being registered with the longitudinal edge of the leg when the first bent tab is received in the receptacle.

19. A foldable support system for a table in accordance with claim 17 wherein the pivot pin is positioned at the top of the slot when the bent tab is seated within the receptacle.

20. A foldable support system for a table in accordance with claim 16 wherein the support comprises 16 gauge sheet metal.

* * * * *